US006049318A

United States Patent [19]

Ota

[11] Patent Number: 6,049,318

[45] Date of Patent: Apr. 11, 2000

[54] DISPLAY CONTROL DEVICE AND DISPLAY CONTROL METHOD

[75] Inventor: Tsutomu Ota, Himeji, Japan

[73] Assignee: Kabushiki Kaisha Toshiba, Kawasaki, Japan

[21] Appl. No.: 08/721,954

[22] Filed: Sep. 27, 1996

[30] Foreign Application Priority Data

Sep. 28, 1995 [JP] Japan ..... 7-250548

[51] Int. Cl.[7] ..... G09G 3/20

[52] U.S. Cl. ..... 345/93; 345/212

[58] Field of Search ..... 345/94, 98, 99, 345/100, 213, 101, 202, 93, 212; 348/790, 792, 793, 294, 571; 340/813

[56] References Cited

U.S. PATENT DOCUMENTS 5,223,824 6/1993 Takeda et al. ..... 340/813
5,450,129 9/1995 Matoba et al. ..... 348/294
5,495,296 2/1996 Dosho et al. ..... 348/571
5,757,352 5/1998 Miyamoto et al. ..... 345/101
5,805,149 9/1998 Yuki et al. ..... 345/202

*Primary Examiner*—Matthew Luu
*Assistant Examiner*—Jeff Piziali
*Attorney, Agent, or Firm*—Pillsbury Madison & Sutro Intellectual Property

[57] ABSTRACT

A display control device for a liquid crystal display is comprised of a detecting section for extracting a horizontal and vertical synchronizing signal from a video signal, a control signal generating circuit for generating a scanning start signal synchronous to the vertical synchronizing signal and a reference clock signal synchronous to the horizontal synchronizing signal, an X-driver circuit for extracting a horizontal picture signal from the video signal in synchronism with the horizontal synchronizing signal and supplying the horizontal picture signal to each of the horizontal pixel lines, and a Y-driver circuit having a shift register for shifting the scanning start pulse in one direction in response to the reference clock signal and selecting the horizontal pixel line corresponding to a holding position of the scanning start pulse, for supplying a selecting signal to the selected horizontal pixel line.

8 Claims, 6 Drawing Sheets

DISPLAY CONTROL DEVICE AND DISPLAY CONTROL METHOD

BACKGROUND OF THE INVENTION

1. Field of the Invention

The present invention relates to a display control device and method for a flat panel display having a plurality of horizontal pixel lines and, more particularly, to a display control device and method for driving the flat panel display by a video signal of a scheme including horizontal picture signals larger in number than the horizontal pixel lines.

2. Description of the Related Art

In recent years, flat panel displays such as a liquid crystal display are used worldwide. With this advance, the liquid crystal display must be arranged to be compatible with all the video information of various media such as NTSC (National Television System Committee), EDTV (Extended Definition Television), PAL (Phase Alternation by Line), a high-vision broadcast, and a car navigation system.

For example, an NTSC video signal includes 480 horizontal picture signals per frame (240 signals per field), whereas a PAL video signal includes 512 horizontal picture signals per frame (256 signals per field). For example, when the PAL video signal is supplied to a liquid crystal display having horizontal pixel lines (horizontal scanning lines) whose number is compatible with the NTSC video signal, the horizontal picture signals of the PAL video signal cannot be properly assigned to the horizontal pixel lines of the liquid crystal display, and it is difficult to perform a normal display.

This problem can be solved by converting the PAL video signal into the NTSC video signal in the display control device for the liquid crystal display. However, a complicated structure is required for this signal conversion processing in order to perform a normal display, resulting in an increase in manufacturing cost of the display control device. For this reason, a conventional display control device is constituted to thin out the horizontal picture signals of the PAL video signal at a predetermined rate. In this case, since the structure of the display control device is simplified, the increase in manufacturing cost can be suppressed.

The horizontal pixel lines of the liquid crystal display are sequentially selected by a Y-driver circuit arranged in the display control device. A typical Y-driver circuit comprises a shift register constituted by a plurality of flip-flops. In this case, the Y-driver circuit receives a reference clock signal A having a frequency corresponding to a horizontal scanning period, as a shift clock signal CPV. In response to the shift clock signal CPV, each flip-plop outputs a scanning start pulse and shifts the start pulse in the next stage. A scanning signal obtained by shifting the level of an output signal from the flip-flop holding the start pulse is supplied to one of of the Y1, Y2, . . . horizontal pixel lines. Therefore, each horizontal picture signal is supplied to the horizontal pixel line selected by the scanning signal and displayed thereon. The above-described thinning processing is performed by generating a scanning inhibit signal GINH every predetermined number of horizontal scanning periods and masking the reference clock signal A and the scanning signal supplied to, e.g., the line Y1 of the horizontal pixel lines by the scanning inhibit signal GINH.

The Y-driver circuit is normally mounted as an individual IC module on the substrate of the liquid crystal display. For this reason, the supply timing of the scanning inhibit signal GINH to the Y-driver circuit does not exactly coincide with the supply timing to the generating circuit of the shift clock signal CPV. On the other hand, the leading and trailing edge timings of the scanning signal are delayed by a response time tpd1, which varies depending on the circuit characteristics of the shift register. If the response time tpd1 of the shift register exceeds a delay time tpd2 of the scanning inhibit signal GINH supplied to the shift register, an interference pulse short in duration is output as a scanning signal, as shown in FIG. 1. This interference pulse changes the pixel potential of the corresponding horizontal pixel line and affects a display image to generate, e.g., an unnecessary stripe. This influence becomes more serious when the number of pixels whose potentials must be set within one horizontal scanning period is increased with an increase in size of the liquid crystal display.

SUMMARY OF THE INVENTION

It is an object of the present invention to provide a display control device and method capable of properly thinning out the horizontal picture signals of a video signal without any erroneous operation.

This object can be attained by a display control device for a flat panel display having a plurality of horizontal pixel lines, the device comprising a control signal generating circuit for generating a scanning start pulse for each vertical scanning cycle of an input video signal and a reference clock signal for each horizontal scanning cycle; a first driver circuit for extracting a horizontal picture signal from the video signal in the horizontal scanning cycle and supplying the horizontal picture signal to each of the horizontal pixel lines; a second driver circuit, having a shift register for shifting the scanning start pulse in one direction in response to the reference clock signal and selecting the horizontal pixel line corresponding to a holding position of the scanning start pulse, for supplying a selecting signal to the selected horizontal pixel line; wherein the control signal generating circuit includes a thinning circuit for generating a mask signal which masks the selecting signal for one horizontal scanning period every predetermined number of horizontal scanning periods to thin out horizontal picture signals from a video signal which the number of horizontal picture signals per frame does not match the number of the horizontal pixel lines, and for inverting the reference clock signal during the one horizontal scanning period.

In the display control device, the horizontal scanning signals are thinned out by inhibiting the supply of a scanning signal for one horizontal scanning period using the inhibit signal. The inhibit signal is used not to mask the reference clock signal A but to invert it during the one horizontal scanning period. Since the shift operation of the shift register is performed before stopping the inhibit signal, an unnecessary pulse can be reliably prevented from being generated depending on the relationship between a delay on the wiring path of the inhibit signal and the response time of the shift register.

DETAILED DESCRIPTION OF THE PREFERRED EMBODIMENTS

A liquid crystal display panel according to the first embodiment of the present invention will be described below with reference to the accompanying drawings.

Figure 1:
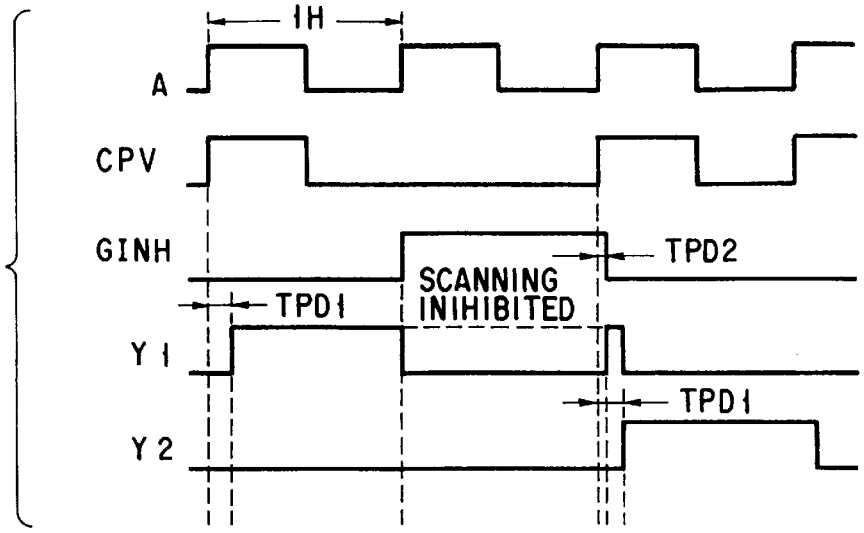
FIG. 1 (PRIOR ART)
FIG. 1 is a timing chart of signals generated in a conventional display control device.
Figure 2:
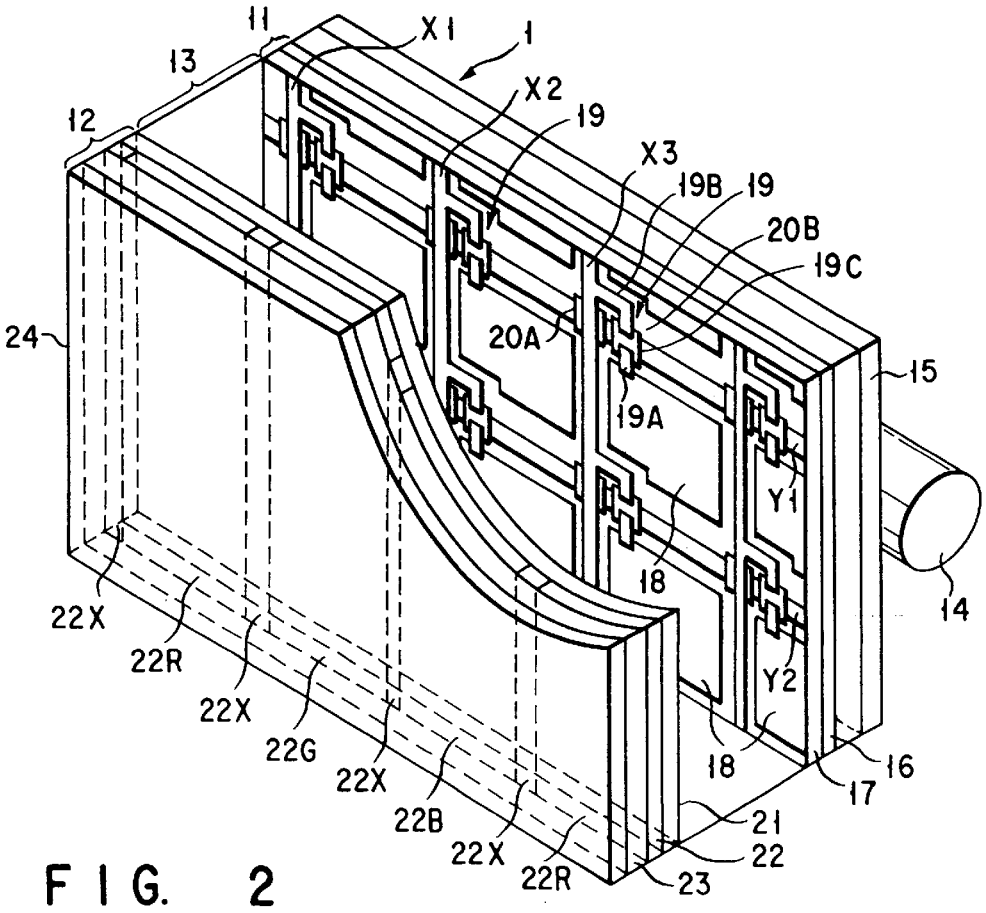
FIG. 2 is a view schematically showing part of a liquid crystal display panel according to the first embodiment of the present invention.

FIG. 2 schematically shows part of the liquid crystal display panel 1. The liquid crystal display panel 1 is constituted by a transparent array substrate 11, a transparent counter substrate 12, and a liquid crystal layer 13. The liquid crystal layer 13 is held between the array substrate 11 and the counter substrate 12. The liquid crystal display panel 1 displays an image by selectively transmitting source light irradiated from a back light 14 arranged on the back side thereof, and supplied via a light diffusing plate 15.

The array substrate 11 comprises a polarizing plate 16, a glass plate 17, and a plurality of transparent pixel electrodes 18. The polarizing plate 16 is arranged to cover the glass plate 17, and polarizes the source light which has been diffused by the light diffusing plate 15. The plurality of transparent pixel electrodes 18 are made of ITO (Indium Tin Oxide) and arrayed in a matrix of 240 rows×320 columns on the glass plate 17 on a side opposite to the polarizing plate 16. The array substrate 11 further comprises 240 scanning lines Y1 to Y240 formed along the rows of the pixel electrodes 18 on the glass plate 17, 320 signal lines X1 to X320 formed along the columns of the pixel electrodes 18 on the glass plate 17, and (240×320) thin-film transistors 19 formed as switching elements on the glass plate 17 near intersections between the scanning lines Y1 to Y240 and the signal lines X1 to X320.

The scanning lines Y1 to Y240 and the signal lines X1 to X320 of the array substrate 11 are insulated from each other by insulating interlayers 20A made of silicon oxide and amorphous silicon and arranged at the intersections therebetween. Each thin-film transistor 19 has an amorphous silicon (or polysilicon) active layer 20B, a source electrode 19A connected to the corresponding pixel electrode 18, a drain electrode 19B connected to the corresponding signal line, and a gate electrode 19C connected to the corresponding scanning line. The gate electrode 19C is insulated from the active layer 20B and formed between the thin-film source and drain electrodes 19A and 19B. With this arrangement, each thin-film transistor 19 is turned on in response to a scanning signal supplied to the gate electrode 19C via the corresponding scanning line, and supplies to the corresponding pixel electrode 18 a picture signal which is supplied via the corresponding signal line to the drain electrode 19B thereof.

The counter substrate 12 comprises a transparent counter electrode 21, a color filter layer 22, a glass plate 23, and a polarizing plate 24. The polarizing plate 24 is arranged to cover the glass plate 23, and polarizes light which has passed through the liquid crystal layer 13. The counter electrode 21 is made of ITO (Indium Tin Oxide), and formed on the glass plate 23 on a side opposite to the polarizing plate 24 to face the matrix array of the pixel electrodes 18. The color filter layer 22 is formed on the glass plate 23 to cover the counter electrode 21. The color filter layer 22 has a plurality of color filter groups each arranged in correspondence with the pixel electrodes 18 in three consecutive columns. Each color filter group has a red filter stripe 22R opposite to the pixel electrodes 18 in the first column, a green filter stripe 22G opposite to the pixel electrodes 18 in the second column, a blue filter stripe 22B opposite to the pixel electrodes 18 in the third column, and light-shielding stripes 22X arranged at the boundaries between these stripes 22R, 22G, and 22B to oppose the corresponding signal lines Xi. Note that the liquid crystal layer 13 is joined to the surface of the array substrate 11 via the first orientation film (not shown) and joined to the surface of the counter substrate 12 via the second orientation film (not shown).

In the above-described liquid crystal display panel 1, 240 horizontal pixel lines are arranged in correspondence with the number of horizontal picture signals of an NTSC video signal per field, and sequentially selected in the row direction (i.e., in the vertical direction on a display screen). Each horizontal pixel line has the pixel electrodes 18 for one row, and each of these pixel electrodes 18 constitutes one pixel in cooperation with the corresponding thin-film transistor 19, the corresponding portion of the polarizing plate, the corresponding portion of the liquid crystal layer, the corresponding portion of the counter electrode, and the corresponding portion of the color filter layer. Each horizontal pixel line has 120 color pixel groups each constituted by three red, green, and blue pixels.

More specifically, the pixel electrodes 18 in a (3K−2)th (K=1, 2, 3, . . . ) column are used to drive a red pixel, the pixel electrodes 18 in a (3K−1)th (K=1, 2, 3, . . . ) column are used to drive a green pixel, and the pixel electrodes 18 in a 3Kth (K=1, 2, 3, . . . ) column are used to drive a blue pixel.

Figure 3:
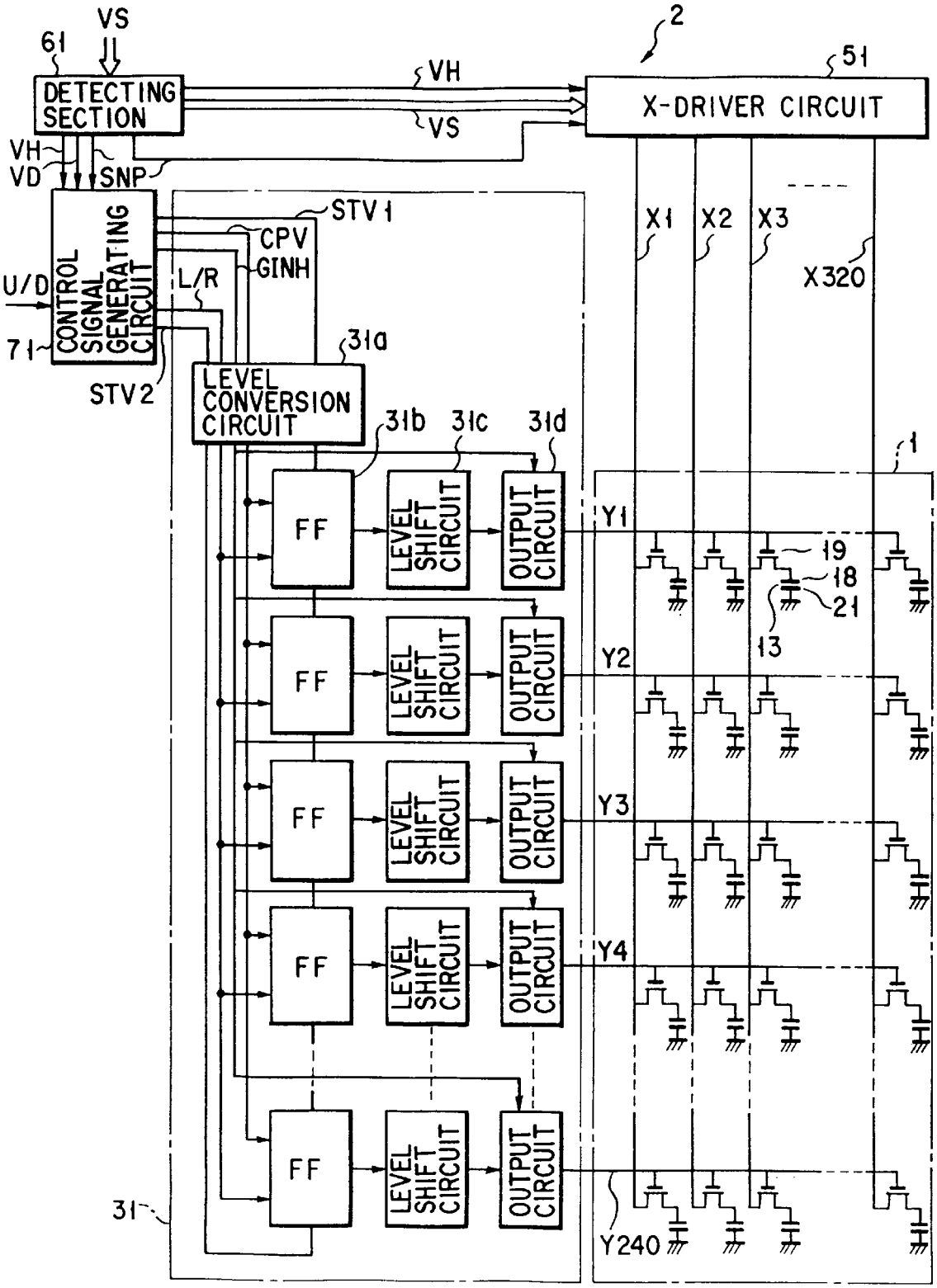
FIG. 3 is a block diagram showing a display control section for controlling the liquid crystal display panel shown in FIG. 2.

FIG. 3 schematically shows a display control section 2 for controlling the liquid crystal display panel 1. This display control section 2 is arranged on that part of the array substrate 11 which is located outside the display screen, i.e., the matrix array of the pixel electrodes 18. The display control section 2 comprises a detecting section 61, an X-driver circuit 51, a Y-driver circuit 31, and a control signal generating circuit 71. The detecting section 61 extracts a vertical synchronizing signal VD and a horizontal synchronizing signal VH from a video signal VS supplied externally, and detects whether the video signal VS is of an NTSC or PAL scheme. The X-driver circuit 51 drives the signal lines X1 to X360 in correspondence with the scheme detected by the detecting section 61. The Y-driver circuit 31 sequentially selects one of the scanning lines Y1 to Y240 in synchronism with the operation of the X-driver circuit 51 which drives the signal lines X1 to X360. The control signal generating circuit 71 supplies various control signals to the Y-driver circuit 31 in accordance with the scheme detected by the detecting section 61.

The detecting section 61 detects the scheme of the video signal VS by checking whether the interval of the vertical synchronizing signal VD is 1/30 sec which corresponds to the NTSC scheme. The detecting section 61 supplies, to the control signal generating circuit 71 and the X-driver circuit 51, a mode signal SNP representing one of the NTSC and PAL display modes which is designated in correspondence with the detection result. The mode signal SNP is supplied along with the vertical synchronizing signal VD and the horizontal synchronizing signal VH to the control signal generating circuit 71. Further, the mode signal SNP is supplied along with the horizontal synchronizing signal VH and the video signal VS to the X-driver circuit 51.

The X-driver circuit 51 has a conventionally known configuration, which includes a sample and hold circuit, an operational amplifier circuit, and a single line memory, for example. The sample and hold circuit samples and holds 320 pixel signals from each horizontal picture signal of the video signal VS in synchronism with the horizontal synchronizing signal VH. The operational amplifier circuit amplifies these pixel signals held by this sample and hold circuit. The line memory stores the 320 pixel signals supplied via the operational amplifier circuit, and supplies them to the signal lines X1 to X320 of the liquid crystal display panel 1. The sample timing and hold period of the sample and hold circuit and the output timing of the line memory are set according to the display mode represented by the mode signal SNP.

The Y-driver circuit 31 comprises a level conversion circuit 31*a*, a shift register 31*b*, 240 level shift circuits 31*c*, and 240 output circuits 31*d*. The level conversion circuit 31*a* performs level-conversion with respect to a shift clock signal CPV, a scanning inhibit signal GINH, a shift direction designating signal L/R, and output start pulses STV1 and STV2 which are supplied from the control signal generating circuit 71. The shift register 31*b* is constituted by a series of 240 flip-flops respectively assigned to the 240 horizontal pixel lines, and shifts the start pulse STV1 or STV2 in response to the shift clock signal CPV. The level shift circuits 31*c* are respectively connected to the flip-flops of the shift register 31*b*. Each level shift circuit 31*c* shifts the level of an output signal from the corresponding flip-flop of the shift register 31*b* when the start pulse is held by the corresponding flip-flop. The output circuits 31*d* are respectively connected to the level shift circuits 31*c*. Each output circuit 31*d* outputs the output signal level-shifted by the corresponding level shift circuit 31*c* to a corresponding one of the scanning lines Y1 to Y240, as a scanning signal for the horizontal pixel line. In the shift register 31*b*, the start pulse STV1 is supplied to the flip-flop corresponding to the first horizontal pixel line, and the start pulse STV2 is supplied to the flip-flop corresponding to the 240th horizontal pixel line. The shift direction designating signal L/R is supplied to the shift register 31*b* to designate the shift directions of the start pulses STV1 and STV2. That is, the Y-driver circuit 31 supplies the scanning signal to the horizontal pixel line corresponding to the flip-flop holding the start pulse STV1 or STV2 during only the hold period. The output operation of the output circuits 31*d* is continuously inhibited while the scanning inhibit signal GINH is supplied.

Figure 4:
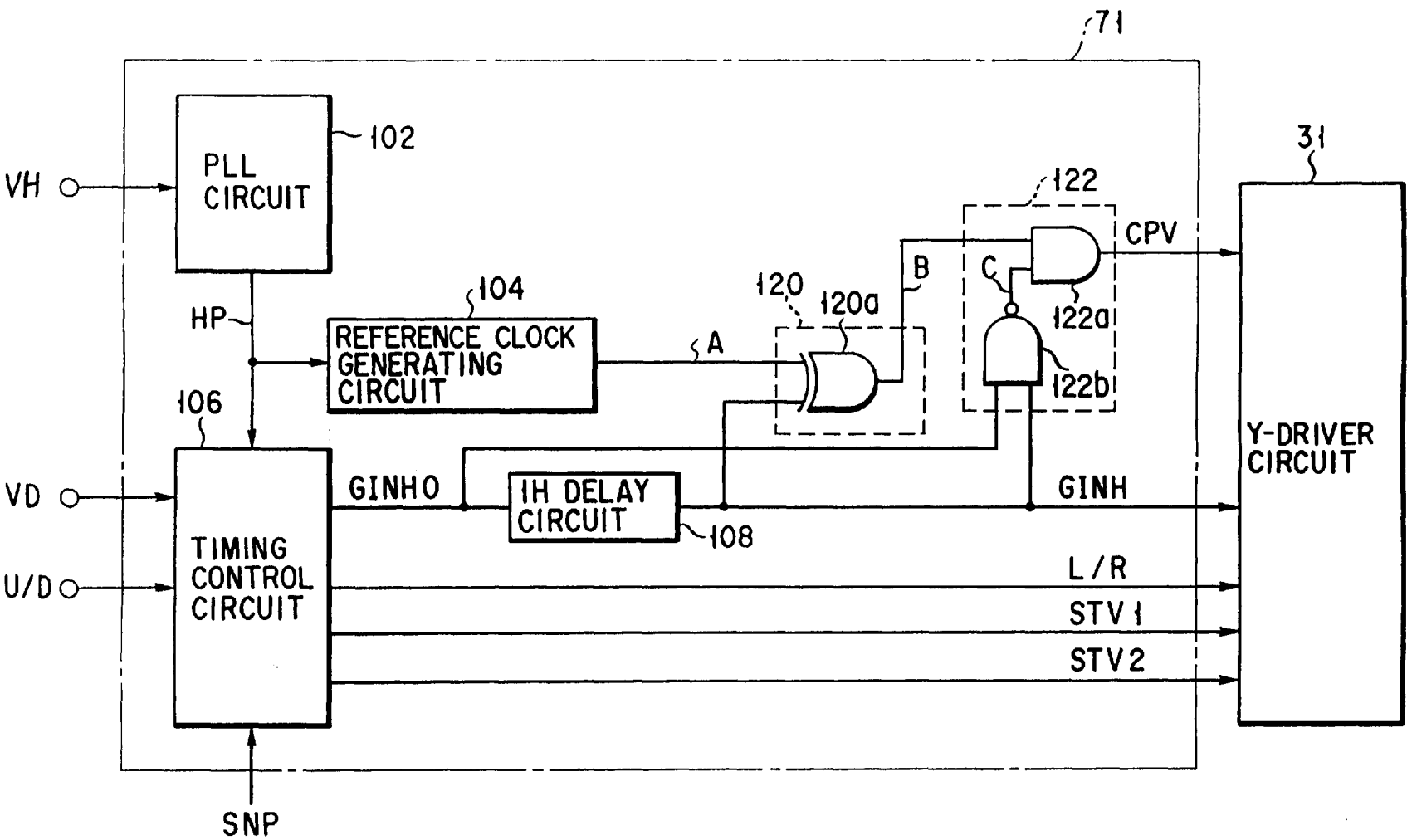
FIG. 4 is a block diagram showing a control signal generating circuit shown in FIG. 3 in detail.

FIG. 4 shows the arrangement of the control signal generating circuit 71 in detail. The control signal generating circuit 71 comprises a PLL (Phase Locked Loop) circuit 102, a reference clock generating circuit 104, a timing control circuit 106, a 1H delay circuit 108, a clock inverting circuit 120, and a gating circuit 122. The PLL circuit 102 generates a horizontal synchronizing pulse having a frequency which is stabilized on the basis of a horizontal scanning period obtained from the horizontal synchronizing signal VH from the detecting section 61. The reference clock generating circuit 104 generates a reference clock signal A synchronous to a horizontal synchronizing pulse HP from the PLL circuit 102. The timing control circuit 106 generates a scanning inhibit signal GINH0, the shift direction designating signal L/R, and the start pulses STV1 and STV2 on the basis of the horizontal synchronizing pulse HP, the vertical synchronizing signal VD, the mode signal SNP, and an up/down inversion designating signal U/D. The 1H delay circuit 108 outputs the scanning inhibit signal GINH obtained by delaying the scanning inhibit signal GINH0 by one horizontal scanning period. The clock inverting circuit 120 inverts the reference clock signal A when the scanning inhibit signal GINH0 is kept at high level. The gating circuit 122 outputs an output signal B of the clock inverting circuit 120 when at least one of the scanning inhibit signals GINH0 and GINH is at low level. The clock inverting circuit 120 is formed of an EXOR gate 120*a* which receives the reference clock signal A and the scanning inhibit signal GINH. The gating circuit 122 is formed of an AND gate 122*a* and a NAND gate 122*b*. The scanning inhibit signals GINH0 and GINH are input to the NAND gate 122*b*, and an output signal C of the NAND gate 122*b* and the output signal B of the gating circuit 122 are input to the AND gate 122*a*. An output signal of the AND gate 122*a* is supplied as the shift clock signal CPV to the Y-driver circuit 31. The up/down inversion designating signal U/D is supplied to the timing control circuit 106 to designate the selection order of the horizontal pixel lines. The timing control circuit 106 determines the shift direction of the shift register 31*b* on the basis of the up/down inversion designating signal U/D. The timing control circuit 106 designates this shift direction by the shift direction designating signal L/R, and selects one of the start pulses STV1 and STV2 according to the shift direction. The selected start pulse is supplied to the shift register 31*b* at the start timing of a field obtained from the vertical synchronizing signal VD. When the mode signal SNP represents the PAL display mode, the timing control circuit 106 generates the scanning inhibit signal GINH0 which is kept for only one horizontal scanning period (1H) every seven horizontal scanning periods (7H). The seven horizontal scanning periods are detected by counting the number of horizontal synchronizing pulses HP. Further, for example, the scanning inhibit signal GINH0 is generated during the first, eighth, 14th, . . . horizontal scanning periods in an odd-numbered field, and generated during the second, ninth, 15th, . . . horizontal scanning periods in an even-numbered field.

The operation of the display control section 2 will be described below. Assume that the start pulse STV1 and the shift direction designating signal L/R are supplied to the Y-driver circuit 31 in order to select the first to 240th horizontal pixel lines in this order. The shift register 31*b* of the Y-driver circuit 31 shifts the start pulse STV1 in response to the shift clock signal CPV. The start pulse STV1 is held by the first flip-flop during a period between the first and second leading edges of the shift clock signal CPV, held by the second flip-flop during a period between the second and third leading edges, held by the third flip-flop during a period between the third and fourth leading edges, and sequentially held by the fourth to 240th flip-flops in the same manner. When the start pulse STV1 is held by the first flip-flop of the shift register 31*b*, the Y-driver circuit 31 continuously supplies a scanning signal to the scanning line Y1. When the start pulse STV1 is held by the second flip-flop, the Y-driver circuit 31 continuously supplies the scanning signal to the scanning line Y2. When the start pulse STV1 is held by the third flip-flop, the Y-driver circuit 31 continuously supplies the scanning signal to the scanning line Y3. Subsequently, the Y-driver circuit 31 supplies the scanning signal to the scanning lines Y4 to Y240 in the same manner.

In the NTSC display mode, the timing control circuit 106 does not generate the scanning inhibit signal GINH0. For this reason, the scanning inhibit signals GINH0 and GINH are always kept at low level. The EXOR gate 120*a* does not invert the reference clock signal A and outputs it as the output signal B. The NAND gate 122*b* outputs the output signal C at high level, and the AND gate 122*a* outputs the output signal B of the EXOR gate 120*a* as the shift clock signal CPV. That is, the reference clock signal A is supplied as the shift clock signal CPV to the shift register 31*b* of the Y-driver circuit 31.

Figure 5:
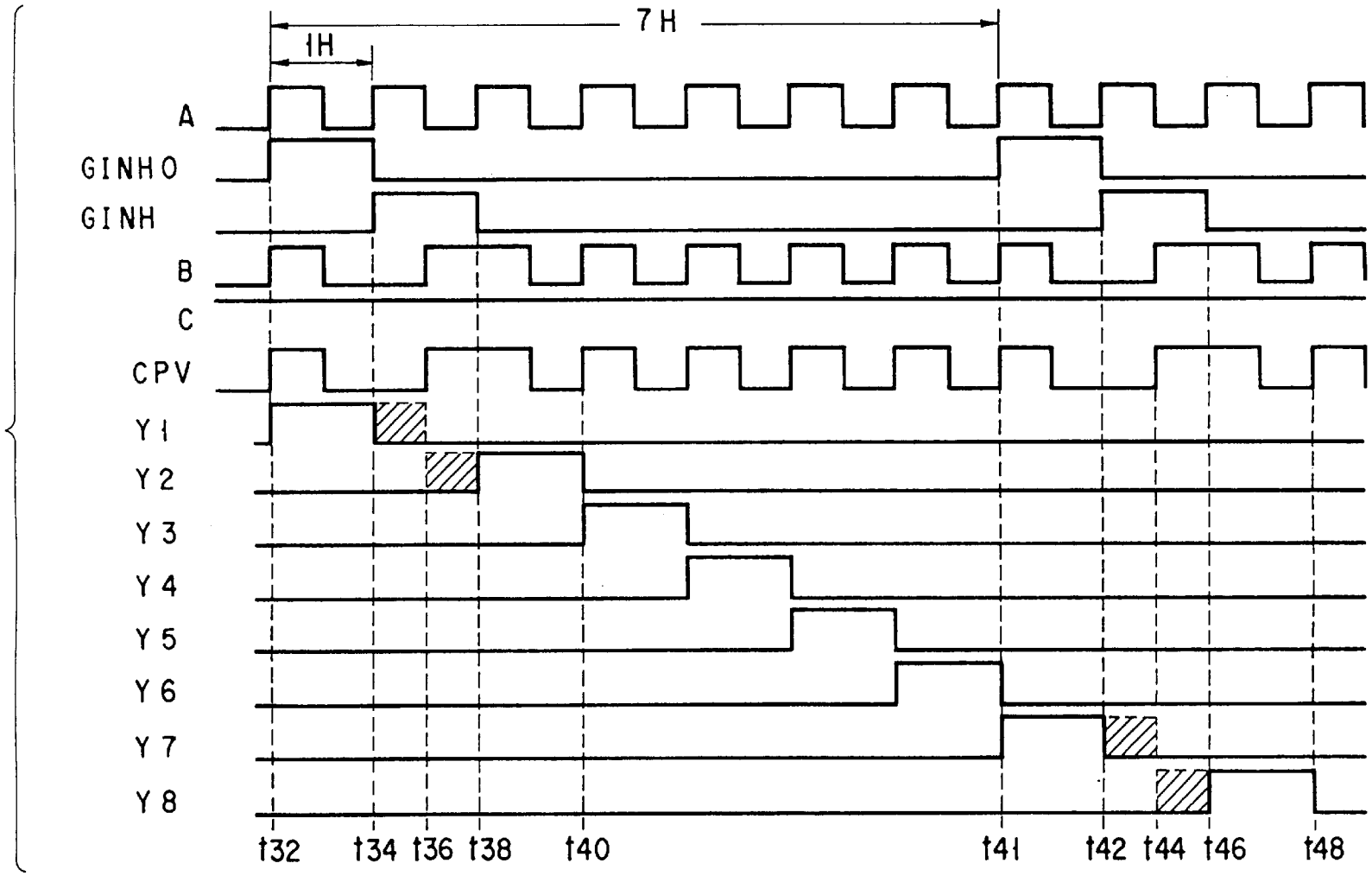
FIG. 5 is a timing chart of signals generated in the control signal generating circuit shown in FIG. 3.

In the PAL display mode, the timing control circuit 106 generates one scanning inhibit signal GINH0 every seven horizontal scanning periods, as shown in FIG. 5. When the scanning inhibit signal GINH0 is set at high level during one horizontal scanning period between time t32 and time t34, the scanning inhibit signal GINH is set at high level during one horizontal scanning period between time t34 and time t38 with a delay of one horizontal scanning period from the scanning inhibit signal GINH0. When the scanning inhibit signal GINH0 is set at high level during one horizontal scanning period between time t41 and time t42, the scanning inhibit signal GINH is set at high level during one horizontal scanning period between time t42 and time t46 with a delay of one horizontal scanning period from the scanning inhibit signal GINH0. The EXOR gate 120*a* outputs the reference clock signal A as the output signal B when the scanning inhibit signal GINH is set at low level, and outputs the inverted signal of the reference clock signal A as the output signal B when the scanning inhibit signal GINH is set at high level. The NAND gate 122*b* outputs the output signal C of high level except when both the scanning inhibit signals GINH0 and GINH are set at high level. The AND gate 122*a* outputs the inverted signal of the reference clock signal A as the shift clock signal CPV during one horizontal scanning period in which the scanning inhibit signal GINH is kept at high level. With this operation, the shift timing of the shift register 31*b* is set earlier by ½ horizontal scanning period. On the other hand, the output operation of the output circuits 31*d* is inhibited during only one horizontal scanning period in which the scanning inhibit signal GINH is kept at high level, thereby causing horizontal picture signal supplied from the X-driver circuit 51 to the signal lines X1 to X320 to be invalid. That is, one horizontal picture signal is thinned out every seven horizontal scanning periods.

In the above-described embodiment, the scanning inhibit signal GINH is used not to mask the reference clock signal A but to invert it. With this setting, the start pulse STV1 is held by the first flip-flop of the shift register 31*b* during a period between, e.g., time t32 and time t36, and held by the second flip-flop of the shift register 31*b* during a period between time t36 and time t40. Since the output circuits 31*d* cannot output a scanning signal during a period between time t34 and time t38 under the control of the scanning inhibit signal GINH, the selecting time of each scanning line is kept for one horizontal scanning period. Since the shift operation of the shift register 31*b* is performed before time t38, an unnecessary pulse can be reliably prevented from being generated depending on the relationship between a delay on the wiring path of the scanning inhibit signal GINH and the response time of the shift register 31*b*.

In addition, the scanning inhibit signal GINH0 is generated during the first, eighth, 14th, . . . horizontal scanning periods in an odd-numbered field, and generated during the second, ninth, 15th, . . . horizontal scanning periods in an even-numbered field. In this case, horizontal picture signals having identical ordinal numbers are not thinned out in the odd- and even-numbered fields. A stripe displayed along a horizontal pixel line can be prevented to obtain a high-quality image.

Figure 6:
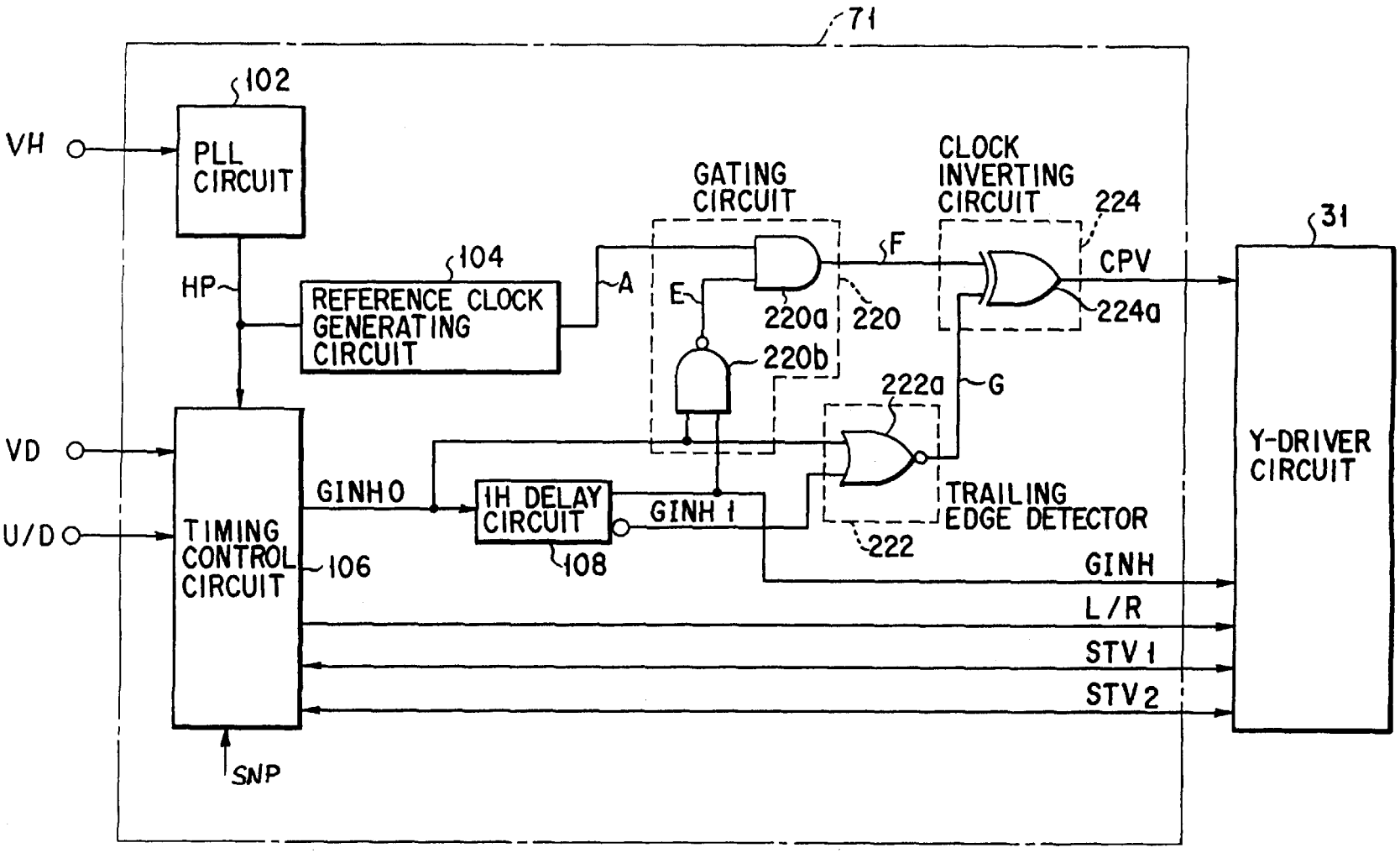
FIG. 6 is a block diagram showing in detail a control signal generating circuit provided to a liquid crystal display panel according to the second embodiment of the present invention.

Next, a liquid crystal display panel according to the second embodiment of the present invention will be described with reference to the accompanying drawings. This liquid crystal display panel has the same arrangement as that of the first embodiment except that a control signal generating circuit 71 is constituted as shown in FIG. 6. Note that the same reference numerals as in the first embodiment denote the similar components, and a detailed description thereof will be omitted.

The control signal generating circuit 71 shown in FIG. 6 comprises a PLL circuit 102, a reference clock generating circuit 104, a timing control circuit 106, a 1H delay circuit 108, a gating circuit 220, a trailing edge detector 222, and a clock inverting circuit 224. The PLL circuit 102 generates a horizontal synchronizing pulse having a frequency which is stabilized on the basis of a horizontal scanning period obtained from a horizontal synchronizing signal VH from a detecting section 61. The reference clock generating circuit 104 generates a reference clock signal A synchronous to a horizontal synchronizing pulse HP from the PLL circuit 102. The timing control circuit 106 generates a scanning inhibit signal GINH0, a shift direction designating signal L/R, and start pulses STV1 and STV2 on the basis of the horizontal synchronizing pulse HP, a vertical synchronizing signal VD, a mode signal SNP, and an up/down inversion designating signal U/D. The 1H delay circuit 108 outputs a scanning inhibit signal GINH obtained by delaying the scanning inhibit signal GINH0 by one horizontal scanning period, and an inverted signal GINH1 thereof. The gating circuit 220 outputs, as an output signal F, the reference clock signal A from the reference clock generating circuit 104 when at least one of the scanning inhibit signals GINH0 and GINH is set at low level. The trailing edge detector 222 detects the trailing edge of the scanning inhibit signal GINH0 and outputs the inverted signal of the inverted signal GINH1 as an output signal G. The clock inverting circuit 224 inverts the output signal F, i.e., the reference clock signal A when the output signal G is kept at high level.

The gating circuit 220 is constituted by a NAND gate 220*b* which receives the scanning inhibit signals GINH0 and GINH, and an AND gate 220*a* which receives an output signal E of the NAND gate 220*b* and the reference clock signal A. The edge detector 222 is constituted by a NOR gate 222*a* which receives the scanning inhibit signals GINH0 and GINH1. The clock inverting circuit 224 is constituted by an EXOR gate 224*a* which receives the output signal F of the AND gate 220*a* and the output signal G of the NOR gate 222*a*. An output signal of the EXOR gate 224*a* is supplied as a shift clock signal CPV to a Y-driver circuit 31. The up/down inversion designating signal U/D is supplied to the timing control circuit 106 to designate the selecting order of the horizontal pixel lines. The timing control circuit 106 determines the shift direction of shift register 31*b* on the basis of the up/down inversion designating signal U/D. The timing control circuit 106 designates this shift direction by the shift direction designating signal L/R, and selects one of the start pulses STV1 and STV2 according to the shift direction. The selected start pulse is supplied to the shift register 31*b* at the start timing of a field obtained from the vertical synchronizing signal VD. When the mode signal SNP represents the PAL display mode, the timing control circuit 106 generates the scanning inhibit signal GINH0 which is kept for only one horizontal scanning period (1H) every seven horizontal scanning periods (7H). The seven horizontal scanning periods are detected by counting the number of horizontal synchronizing pulses HP. Further, for example, the scanning inhibit signal GINH0 is generated during the first, eighth, 14th, . . . horizontal scanning periods in an odd-numbered field, and generated during the second, ninth, 15th, . . . horizontal scanning periods in an even-numbered field.

The operation of a display control section 2 having the control signal generating circuit 71 shown in FIG. 6 will be described below. Assume that the start pulse STV1 and the shift direction designating signal L/R are supplied to the Y-driver circuit 31 in order to select the first to 240th horizontal pixel lines in this order. The shift register 31*b* of the Y-driver circuit 31 shift the start pulse STV1 in response to the shift clock signal CPV. The start pulse STV1 is held by the first flip-flop during a period between the first and second leading edges of the shift clock signal CPV, held by the second flip-flop during a period between the second and third leading edges, held by the third flip-flop during a period between the third and fourth leading edges, and sequentially held by the fourth to 240th registers in the same manner. When the start pulse STV1 is held by the first flip-flop of the shift register 31*b*, the Y-driver circuit 31 continuously supplies a scanning signal to a scanning line Y1. When the start pulse STV1 is held by the second flip-flop, the Y-driver circuit 31 continuously supplies the scanning signal to a scanning line Y2. When the start pulse STV1 is held by the third flip-flop, the Y-driver circuit 31 continuously supplies the scanning signal to a scanning line Y3. Subsequently, the Y-driver circuit 31 supplies the scanning signal to scanning lines Y4 to Y240 in the same manner.

In the NTSC display mode, the timing control circuit 106 does not generate the scanning inhibit signal GINH0. For this reason, the scanning inhibit signals GINH0 and GINH are always kept at low level. The NAND gate 220*b* supplies the output signal E of high level, and the AND gate 220*a* supplies the reference clock signal A as the output signal F. The EXOR gate 224*a* does not invert the output signal F from the AND gate 220*a* and supplies it as the shift clock signal CPV. That is, the reference clock signal A is supplied as the shift clock signal CPV to the shift register 31*b* of the Y-driver circuit 31.

Figure 7:
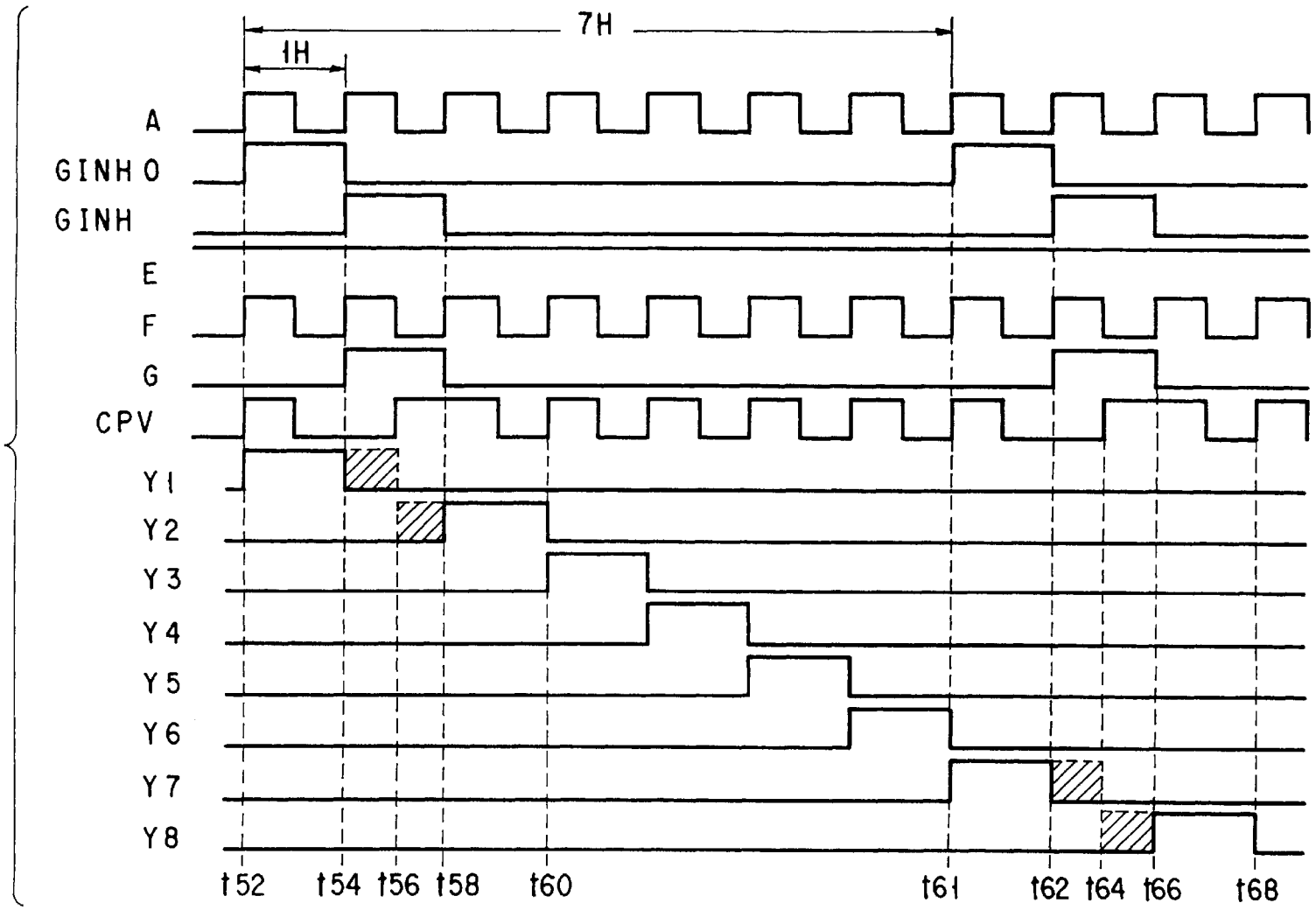
FIG. 7 is a timing chart of signals generated in the control signal generating circuit shown in FIG. 6.

In the PAL display mode, the timing control circuit 106 generates one scanning inhibit signal GINH0 every seven horizontal scanning periods, as shown in FIG. 7. When the scanning inhibit signal GINH0 is set at high level during one horizontal scanning period between time t52 and time t54, the scanning inhibit signal GINH is set at high level during one horizontal scanning period between time t54 and time t58 with a delay of one horizontal scanning period from the scanning inhibit signal GINH0. When the scanning inhibit signal GINH0 is set at high level during one horizontal scanning period between time t61 and time t62, the scanning inhibit signal GINH is set at high level during one horizontal scanning period between time t62 and time t66 with a delay of one horizontal scanning period from the scanning inhibit signal GINH0. The NAND gate 220*b* outputs the output signal E of high level except when both the scanning inhibit signals GINH0 and GINH are set at high level. The AND gate 220*a* outputs the reference clock signal A as the output signal F. The EXOR gate 224*a* outputs the output signal F, i.e., the reference clock signal A as the shift clock signal CPV when the output signal G is set at low level, and outputs the inverted signal of the reference clock signal A as the shift clock signal CPV when the output signal G is set at high level. With this operation, the shift timing of the shift register 31*b* is set earlier by ½ horizontal scanning period. On the other hand, the output operation of the output circuits 31*d* is inhibited during only one horizontal scanning period wherein the scanning inhibit signal GINH is kept at high level, thereby causing one horizontal picture signal supplied from an X-driver circuit 51 to signal lines X1 to X320 to be invalid. That is, one horizontal picture signal is thinned out every seven horizontal scanning periods.

In the second embodiment, as in the first embodiment, the scanning inhibit signal GINH is not used to mask the reference clock signal A. With this setting, the start pulse STV1 is held by the first flip-flop of the shift register 31*b* during a period between, e.g., time t52 and time t56, and held by the second flip-flop of the shift register 31*b* during a period between time t56 and time t60. Since the output circuits 31*d* cannot output a scanning signal during a period between time t54 and time t58 under the control of the scanning inhibit signal GINH, the selecting time of each scanning line is kept for one horizontal scanning period. Since the shift operation of the shift register 31*b* is performed before time t58, an unnecessary pulse can be reliably prevented from being generated depending on the relationship between a delay on the wiring path of the scanning inhibit signal GINH and the response time of the shift register 31*b*.

In addition, the scanning inhibit signal GINH0 is generated during the first, eighth, 14th, . . . horizontal scanning periods in an odd-numbered field, and generated during the second, ninth, 15th, . . . horizontal scanning periods in an even-numbered field. In this case, horizontal picture signals having identical ordinal numbers are not thinned out in the odd- and even-numbered fields. A stripe displayed along a horizontal pixel line can be prevented to obtain a high-quality image.

Note that the above-described embodiments have arrangements wherein one horizontal picture signal is thinned out every seven horizontal scanning periods. However, if the synchronization of the scanning inhibit signal GINH0 is adjusted, the present invention can also be applied to a video signal of another scheme using the different number of horizontal picture signals.

Further, the liquid crystal display panels according to these embodiments are of an active matrix scheme wherein pixel electrodes are driven via thin-film transistors. The present invention can also be applied to another display device using a plasma, an LED, or the like. Moreover, the present invention can also be applied to a field emission display (FED) which has been studied and developed in recent years.

What is claimed is:

1. A display control device for a flat panel display having a plurality of horizontal pixel lines, said device comprising:

a signal generator for generating a scanning start pulse for each vertical scanning cycle of an input video signal and generating a reference clock signal for each horizontal scanning cycle of said input video signal;

a first driver for extracting a set of horizontal picture signals from said video signal and supplying said set of horizontal picture signals to respective ones of said horizontal pixel lines, each said set of horizontal picture signals comprising a frame;

a second driver, comprising a shift register for shifting said scanning start pulse in one direction in response to said reference clock signal and selecting as a selected horizontal pixel line one of said horizontal pixel lines corresponding to a holding position of said scanning start pulse, for supplying a selecting signal to said selected horizontal pixel line;

said signal generator comprising a thinning mechanism for generating a mask signal which masks said selecting signal for one horizontal scanning cycle out of every predetermined number of horizontal scanning cycles to thin out horizontal picture signals from said input video signal to produce a thinned video signal when each said set of horizontal picture signals comprises a number of horizontal picture signals exceeding the number of said horizontal pixel lines, and for generating an inhibit signal for inverting said reference clock signal during said one horizontal scanning cycle.

2. The display control device according to claim 1, wherein said thinning mechanism comprises a timing controller for shifting a time at which said inhibit signal is generated to thin out horizontal picture signals of an ordinal number in odd and even numbered ones of said fields and to thin out horizontal picture signals of a different ordinal number in even numbered ones of said fields when said horizontal pixel lines are assigned to horizontal picture signals corresponding to images of the odd and even numbered fields to be combined into an image of one frame.

3. The display control device according to claim 1, wherein said signal generator means includes a detector for detecting from the vertical scanning cycle of said input video signal, a video signal comprising a number of horizontal picture signals per frame not matching the number of said horizontal pixel lines.

4. The display control device according to claim 1, wherein said thinning mechanism includes an inverting circuit for inverting the reference clock signal when receiving said inhibit signal.

5. A display control device according to claim 4, wherein said thinning mechanism comprises:

a signal generating circuit for generating, during one horizontal scanning cycle out of every predetermined number of scanning cycles, a reference inhibit signal maintained for one horizontal scanning cycle;

a delay circuit for delaying the reference inhibit signal by one horizontal scanning cycle to generate said inhibit signal; and a gating circuit for disabling said reference clock signal to be supplied to said second driver when receiving both said inhibit signal and said reference inhibit signal.

6. A display control method for a flat panel display having a plurality of horizontal pixel lines, comprising:

generating a scanning start pulse for each vertical scanning cycle of an input video signal and a reference clock signal for each horizontal scanning cycle of said input video signal;

extracting a set of horizontal picture signals from said video signal and supplying said set of horizontal picture signals to respective ones of said horizontal pixel lines, each said set of horizontal picture signals comprising a frame; and shifting said scanning start pulse in one direction in response to said reference clock signal, selecting as a selected horizontal pixel line one of said horizontal pixel lines corresponding to a holding position of said scanning start pulse, and supplying a selecting signal to said selected horizontal pixel line;

said signal generating comprising generating a mask signal which masks said selecting signal for one horizontal scanning cycle out of every predetermined number of horizontal scanning cycles to thin out horizontal picture signals from said input video signal to produce a thinned video signal when each said set of horizontal picture signals comprises a number of horizontal picture signals exceeding the number of said horizontal pixel lines, and generating an inhibit signal which inverts said reference clock signal during said one horizontal scanning cycle.

7. A display control device for a flat panel display having a plurality of horizontal pixel lines, said device comprising:

signal generating means for generating a reference clock signal for each horizontal scanning cycle of an input video signal;

first driving means for extracting a set of horizontal picture signals from said video signal and supplying said set of horizontal picture signals to respective ones of said horizontal pixel lines, each said set of horizontal picture signals comprising a frame;

second driving means comprising a selecting section for selecting as a selected horizontal pixel line one of said horizontal pixel lines in sequence, for supplying a selecting signal to said selected horizontal pixel line;

said signal generating means comprising thinning means for generating a mask signal which masks said selecting signal for one horizontal scanning cycle out of every predetermined number of horizontal scanning cycles to thin out horizontal picture signals from said input video signal to produce a thinned video signal when each said set of horizontal picture signals comprises a number of horizontal picture signals exceeding the number of said horizontal pixel lines, and for generating an inhibition signal which changes a duration of said reference clock signal such that the selection by said selecting section is previously updated to select a next horizontal pixel line in said one horizontal scanning cycle.

8. A display control device for a flat panel display having a plurality of horizontal pixel lines, said device comprising:

signal generator means for generating a scanning start pulse for every vertical scanning cycle of an input video signal and for generating a reference clock signal for each horizontal scanning cycle of said input video signal;

first driving means for extracting a set of horizontal signals from said video signal and for supplying said set of horizontal picture signals to respective ones of said horizontal pixel lines, each said set of horizontal picture signals comprising a frame;

second driving means for supplying a selecting signal to said selected horizontal pixel line by using a shift register for shifting said scanning start pulse in one direction in response to said referenced clock signal and selecting as a selected horizontal pixel line one of said horizontal pixel lines corresponding to a holding position of said scanning start pulse;

said signal generating means comprising thinning means for generating a mask signal which masks said selecting signal for one horizontal scanning cycle out of every predetermined number of horizontal scanning cycles to thin out horizontal picture signals from said input video signal to produce a thinned video signal when each said set of horizontal picture signals comprises a number of horizontal picture signals exceeding the number of said horizontal pixel lines, and for generating an inhibit signal for inverting said referenced clock signal during said one horizontal scanning cycle.

* * * * *